US005664959A

United States Patent [19]

Duell et al.

[11] Patent Number: 5,664,959

[45] Date of Patent: Sep. 9, 1997

[54] ELECTRICAL CONNECTOR PLUG

[75] Inventors: Richard J. Duell, Syracuse; Roger J. Voorhis, Pennellville, both of N.Y.

[73] Assignee: Carrier Corporation, Syracuse, N.Y.

[21] Appl. No.: 772,477

[22] Filed: Dec. 23, 1996

Related U.S. Application Data

[63] Continuation of Ser. No. 573,097, Dec. 15, 1995.

[51] Int. Cl.[6] ..... H01R 13/52

[52] U.S. Cl. ..... 439/278; 439/680; 439/685

[58] Field of Search ..... 439/687, 685, 439/682, 559, 278, 281, 680, 681, 521

[56] References Cited

U.S. PATENT DOCUMENTS

| | | | |
|---|---|---|---|
| 2,458,748 | 1/1949 | Stupakoff | 174/152 |
| 2,728,060 | 12/1955 | Doeg | 339/191 |
| 3,160,460 | 12/1964 | Wyzenbeek | 339/176 |
| 3,206,715 | 9/1965 | Skony | 339/192 |
| 3,345,605 | 10/1967 | Looke | 339/192 |
| 3,601,780 | 8/1971 | DeLyon et al. | 339/192 |
| 3,622,948 | 11/1971 | Foster | 439/685 |
| 3,721,948 | 3/1973 | Brandt et al. | 339/176 R |
| 3,850,496 | 11/1974 | Hague | 339/64 M |
| 4,523,798 | 6/1985 | Barrows et al. | 339/192 RI |
| 4,840,547 | 6/1989 | Fry | 417/422 |
| 4,984,973 | 1/1991 | Itameri-Kinter et al. | 417/422 |
| 5,145,417 | 9/1992 | Honkomp et al. | 439/685 |
| 5,173,057 | 12/1992 | Bunch et al. | 439/685 |

*Primary Examiner*—Neil Abrams
*Assistant Examiner*—Tho Dac Ta

[57] ABSTRACT

A connector plug (10, 20) for making electrical connection to the terminal assembly (40) of a hermetic compressor for an air conditioning or refrigeration system. The plug has a flexible skirt (15) that extends axially downward to fit snugly over the shoulder (43) of the body (41) of the terminal assembly when connected. An ear (16, 26) extends from the side wall (13) of the plug and has an engaging slot (17) which is sized and configured so that the engaging slot engages a stud (52) that extends from the compressor shell (51) in the vicinity of the terminal assembly when the plug is correctly installed on the terminal assembly. The ear may also include a cavity for receiving a thermal overload sensor (71) that may be associated with the compressors.

2 Claims, 4 Drawing Sheets

ELECTRICAL CONNECTOR PLUG

This application is a continuation of application Ser. No. 08/573,097, filed Dec. 15, 1995.

BACKGROUND OF THE INVENTION

This invention relates generally to electrical connectors. More particularly, the invention relates to a plug for connecting electrical leads to the terminal posts of a hermetic compressor for use in a refrigeration or air conditioning system.

A large percentage of the hermetic refrigeration and air conditioning compressors in use or being manufactured today have a terminal assembly for conducting electrical power through the shell of the compressor. FIG. 1 shows a typical terminal assembly 40 having a body member 41 with a shoulder 43. At least two, and usually three, axially aligned terminal posts 42 pass through body member 41, with each post 42 having inner end 42I and outer end 42O.

FIG. 2 shows terminal assembly 40 mounted in the upper portion of shell 51 of compressor 50. Body member 41 extends through shell 51 and is welded or otherwise secured to shell 51 with the shoulder 43 extending a short distance beyond the outer surface of shell 51. Electrical leads 62 from the compressor motor (not shown) connect to inner ends 42I by means of connector plug 61. Electrical power is supplied to the compressor by a plug and leads (not shown) connected to post outer ends 42O. Power leads may be individually connected to the terminal posts, or the leads may terminate in a common connector plug that connects to the posts. FIGS. 3 and 4 depict such a plug 80 in which each electrical lead 83 terminates in its own axially aligned connector cavity 82 in plug body 81. As will be seen in FIG. 4, plug 80 does not completely cover terminal posts 42 when it is installed.

Referring again to FIG. 2, some, but not all, compressors have thermal sensor 71, mounted on the top of shell 51 in proximity to terminal assembly 41. Sensor 71 monitors the temperature of shell 51 for purposes of overload protection. An abnormally high shell temperature would indicate that there is an overload condition in the compressor. If the shell temperature reaches such a predetermined value, a signal from sensor 71 initiates a system shutdown to protect the compressor. Stud 52 is secured to and extends from shell 51, and cover 54 fits over terminal assembly 41 and sensor 71 with nut 53 securing the cover in place. Cover 54 engages a portion of the thermal sensor 71 to hold it in place, and also prevents the insertion of foreign objects, such as tools, between plug 80 and terminal assembly 43. Foreign objects could cause an electrical short circuit between or among terminal posts 42. Cover 54 also prevents moisture from reaching terminal posts 42.

If the external power leads do not terminate in a common connector plug, it is easily possible to connect the leads incorrectly. Even if there is a connector plug like plug 80 (FIGS. 3 and 4), because of the configuration and orientation of the terminal posts with respect to each other, it is possible to install the plug incorrectly and therefore connect a lead to an incorrect post. If the leads are installed incorrectly, improper operation or damage to the compressor may result.

In order to simplify assembly, reduce the number of parts and therefore reduce costs, it would be desirable to eliminate the cover 54 (FIG. 2). What is needed is an improved device that reduces the possibility of incorrectly connecting the external electrical power leads to the terminal assembly of a hermetic compressor, protects the terminal posts from exposure to incidental moisture and short circuiting, and eliminates the need for a separate connector cover. If there is a thermal sensor, the device should also be capable of holding it in place. The device should be adaptable for use with a compressor with no modification to the compressor itself.

SUMMARY OF THE INVENTION

The present invention is an electrical connector plug that overcomes the shortcomings of prior art apparatus for connecting external electrical leads to a hermetic compressor, for securing a thermal sensor to the compressor shell and for protecting the electrical connections from damage.

The present invention has a flexible skirt that surrounds its electrical connector cavities. When the plug is connected and in place on a terminal assembly, the skirt fits snugly over the shoulder of the terminal body so that incidental moisture cannot contact the terminal posts and also so that a foreign object cannot easily be inserted between the terminal assembly and the plug. An ear extends from the side wall of the plug and has a vertical opening or other engaging means formed in it. The ear and engaging means are sized and configured so that the ear opening can engage the stud that extends from the compressor shell at the same time that the electrical connector cavities in the plug engage the terminal posts. It is possible to install the plug of the present invention incorrectly but the incorrect installation would be readily apparent. A nut can be threaded on to the stud to prevent the plug from becoming disconnected from the terminal assembly due to vibration or the like.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 5:
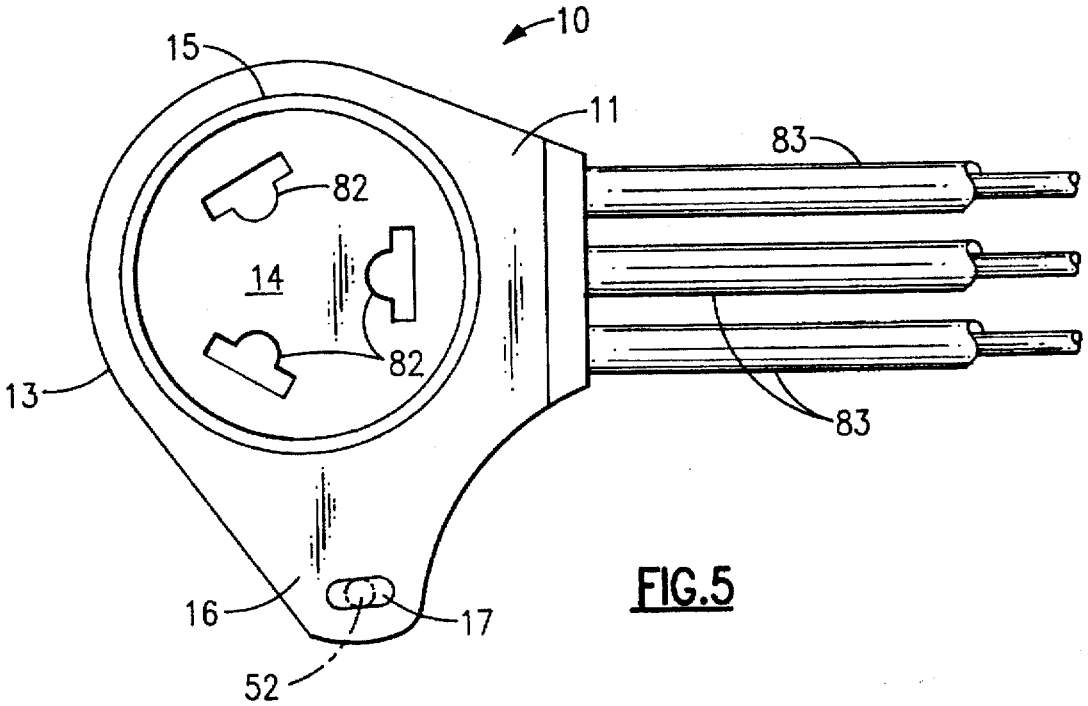
FIG. 5 is a bottom view of the connector plug of the present invention.
Figure 6:
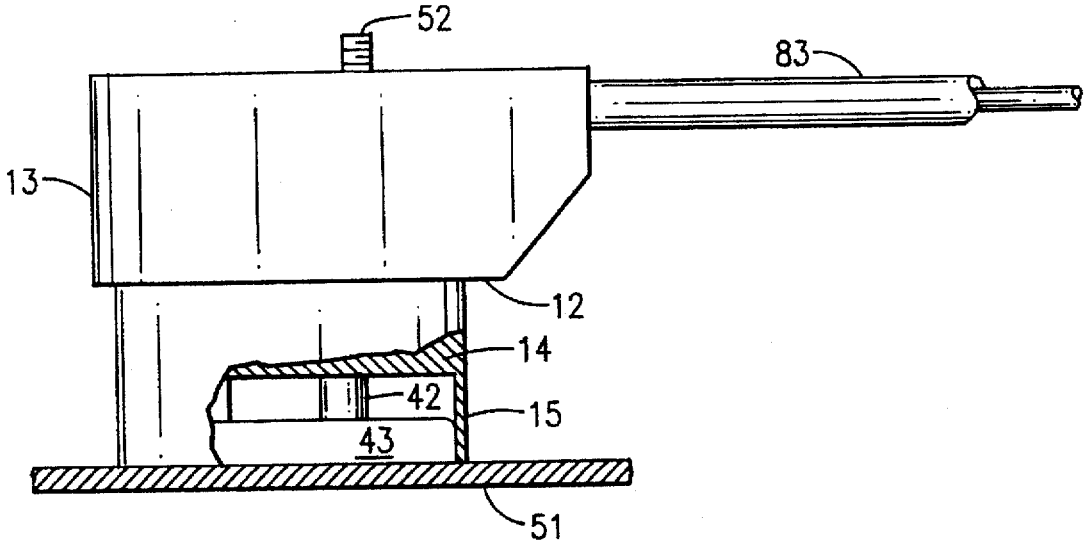
FIG. 6 is a side view thereof, partially broken away.

FIGS. 5 and 6 show the essential features of the plug of the present invention. Connector plug 10 comprises a body 11, with a lower face 12, side wall 13 and boss 14. A skirt 15 is integrally attached to the boss 14 and an ear 16 is integrally attached to the body 11 as shown. A stud engaging slot 17 is formed in the ear 16 so as to receive stud 52 therein. Boss 14 extends from lower face 12 and contains connector cavities 82, which are connected electrically to electrical leads 83 in a conventional manner not shown.

Figure 2:
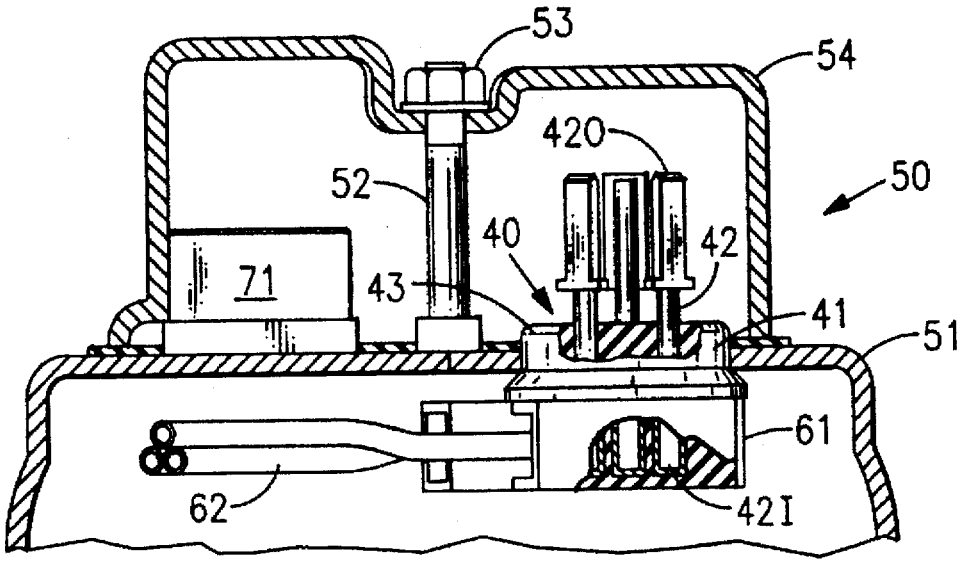
FIG.2 Prior Art
FIG. 2 is a prior art partial section view of a hermetic compressor.
Figure 1:
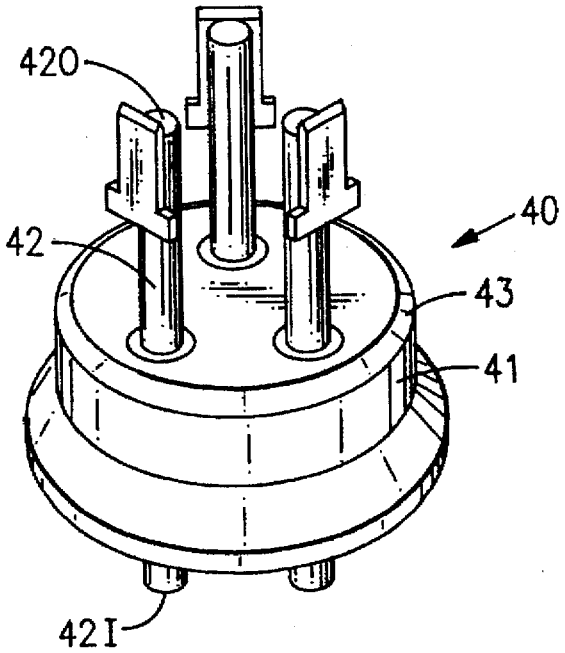
FIG.1 Prior Art
FIG. 1 is a prior art isometric view of a terminal assembly.
Figure 3:
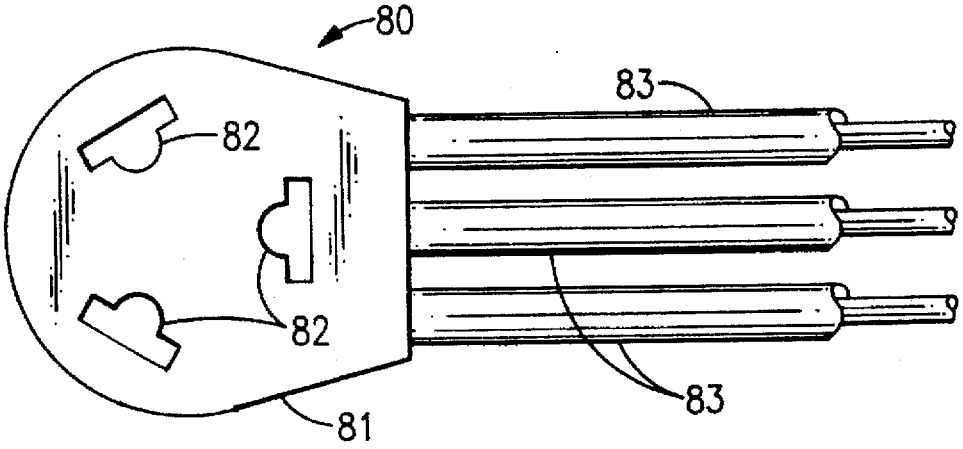
FIG.3 Prior Art
FIG. 3 is a bottom view of a prior art electrical connector plug.
Figure 4:
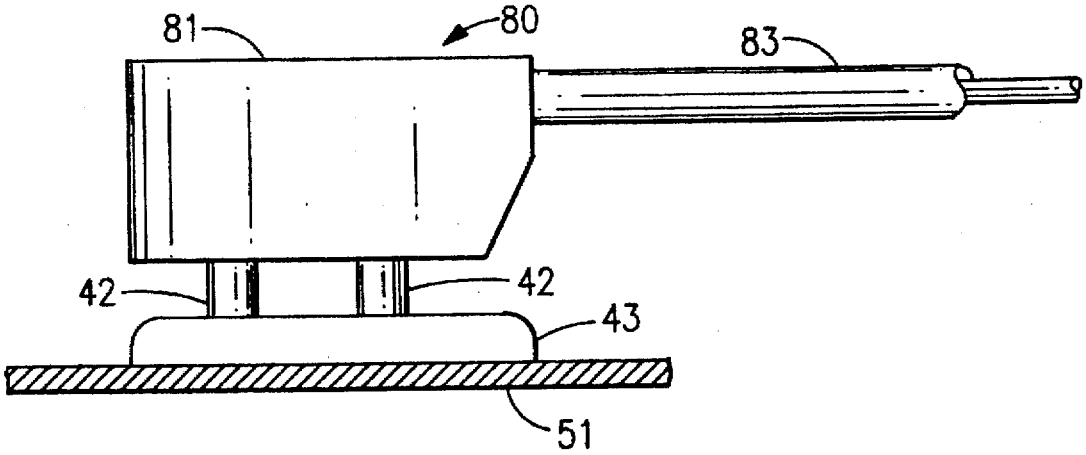
FIG.4 Prior Art
FIG. 4 is a prior art side view thereof, installed on a terminal assembly.

Skirt 15 extends axially from boss 14 and surrounds connector cavities 82. Skirt 15 is flexible and is sized and configured so that when plug 10 is connected to terminal assembly 40 (FIGS. 1 and 2), skirt 15 fits snugly over shoulder 43. When so positioned, skirt 15 protects terminal posts 42 from the impingement of incidental moisture and the insertion of foreign objects.

Ear 16 extends laterally and integrally from side wall 13. The spacing and relative positioning of the three terminal posts 42 are such that plug 10 may be connected to terminal assembly 40 with any one of connector cavities 82 engaging any one of the three terminal posts. There is, however, only one correct way to connect the plug to the terminal assembly. The orientation and sizing of the ear 16, as well as that of the engaging slot 17, are such that when plug 10 is correctly connected to terminal assembly 40 (FIGS. 1 and 2), stud 52 extends through engaging slot 17. It is possible to connect plug 10 to terminal assembly 40 in an incorrect orientation. In that case, however, stud 52 would not extend through engaging slot 17 and the incorrect connection of plug to assembly would be easily recognized by the installer.

Figure 7:
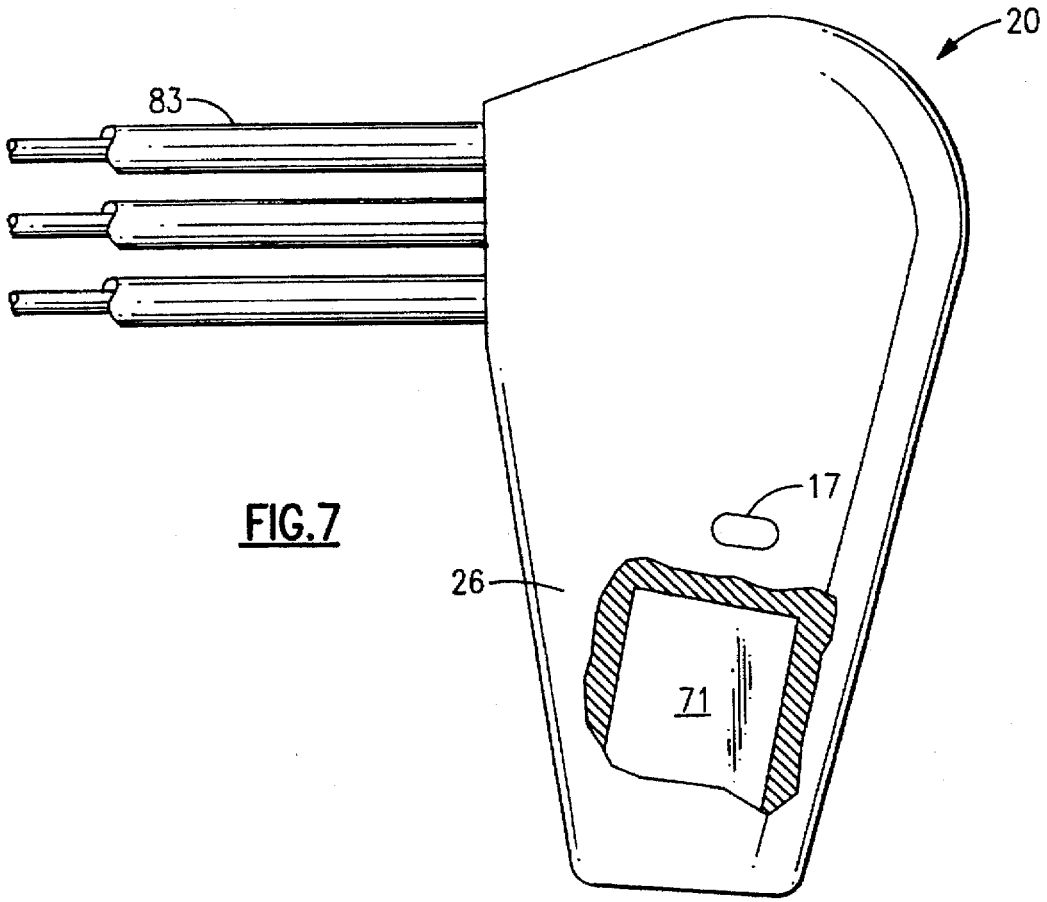
FIG. 7 is a top view, partially broken away, of another embodiment of the connector plug of the present invention installed on a terminal assembly.
Figure 8:
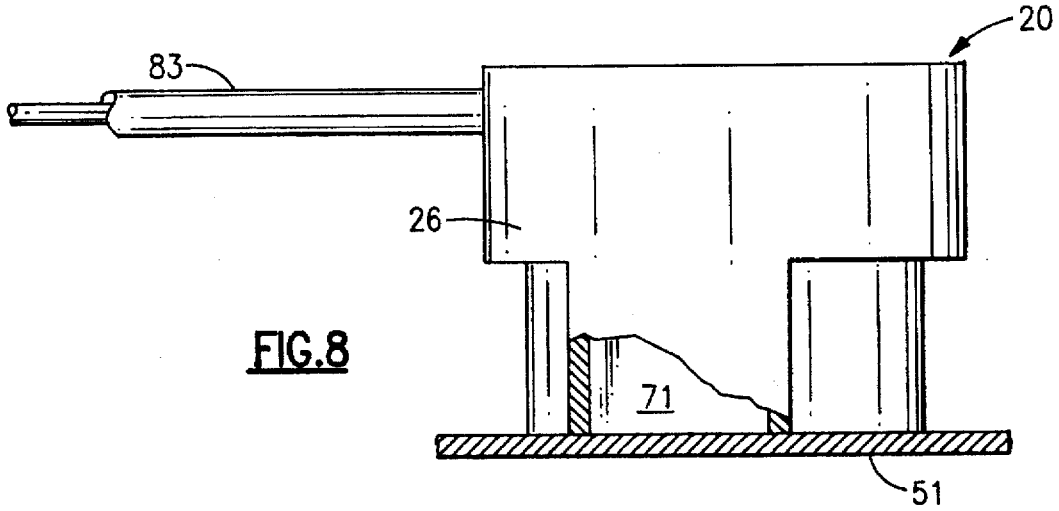
FIG. 8 is a side view thereof, partially broken away.

FIGS. 5 and 6 depict an embodiment of the connector plug of the present invention, which is suited for use with a compressor that does not have a thermal overload sensor. FIGS. 7 and 8 illustrate another embodiment that is suitable for use with a compressor have such a sensor. Connector plug 10 has all the features of connector plug 10 shown in FIGS. 5 and 6. Ear 26 of plug 20, however, is enlarged so that thermal overload sensor 71 may be received into a cavity in ear 26, so that the sensor 71 is held in place by the ear. Sensor 71 is connected electrically to one of the three electrical leads 83 and one of the compressor terminal posts in a conventional manner not shown. With connector 20 correctly installed on terminal assembly 40, sensor 71 is maintained in good thermal contact with compressor shell 51.

We claim:

1. An improved electrical plug connector of the type having a body with a plurality of axially aligned cavities for receiving therein, respective terminal posts extending axially from a terminal assembly of a compressor having a thermal sensor in direct contact with its shell, wherein the improvement comprises:

a flexible skirt integrally attached to and extending axially from the body and so sized and shaped that when the connector is installed over the terminal posts, said flexible skirt fits tightly over the terminal assembly to provide a sealed relationship therebetween;

and said body includes an ear extending laterally from one side thereof, said ear being so sized and shaped as to fit snugly over said sensor to cover and hold it in place against the compressor shell.

2. A connector plug for making electrical connection to a terminal of a compressor having a thermal sensor in direct contact with its shell, said terminal assembly having at least two terminal posts and an associated stud that extends generally parallel to said terminal posts, comprising:

a body having a boss extending therefrom;

electrical connector cavities, one for each said terminal post, formed in said boss and formed and spaced so as to receive the terminal posts, therein;

a skirt integrally attached to and extending from said boss and sized and shaped so as to fit snugly over the terminal assembly when the plug is in its installed position;

an ear extending from said body, said ear having means for engaging said stud, said engaging means being arranged with respect to said connector cavities so that of said engaging means with said stud provides assurance of correct engagement of said connector plug with said terminal;

said ear further having a cavity for receiving the thermal sensor therein such that said ear covers the sensor and holds it in its installed position against the shell.

* * * * *